US010797426B2

(12) United States Patent
Zhao et al.

(10) Patent No.: US 10,797,426 B2
(45) Date of Patent: Oct. 6, 2020

(54) ELECTRICAL CONNECTOR UPPER AND LOWER CONTACTS MADE FROM A SINGLE CONTACT CARRIER AND INSULATIVE HOUSING MOLDED BY ONE SHOT

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/666,301

(22) Filed: Oct. 28, 2019

(65) Prior Publication Data

US 2020/0136292 A1 Apr. 30, 2020

(30) Foreign Application Priority Data

Oct. 29, 2018 (CN) ..... 2018 1 1265481

(51) Int. Cl.
*H01R 3/00* (2006.01)
*H01R 13/405* (2006.01)
(Continued)

(52) U.S. Cl.
CPC ..... *H01R 13/405* (2013.01); *H01R 13/6273* (2013.01); *H01R 43/16* (2013.01); *H01R 43/24* (2013.01)

(58) Field of Classification Search
CPC ..... H01R 13/7175; H01R 23/70073; H01R 23/7068; H05K 1/117
(Continued)

(56) References Cited

U.S. PATENT DOCUMENTS 4,808,115 A * 2/1989 Norton ..... G02B 6/381 439/79
4,887,353 A * 12/1989 Preputnick ..... H01R 12/725 29/830
(Continued)

FOREIGN PATENT DOCUMENTS

CN 102280735 U 12/2011
CN 104882696 A 9/2015
(Continued)

*Primary Examiner* — Phuong Chi Thi Nguyen
(74) *Attorney, Agent, or Firm* — Wei Te Chung; Ming Chieh Chang

(57) ABSTRACT

A method of making an electrical connector which includes an insulative housing having a tongue with two opposite surfaces and plural contacts with contacting portions exposed to the two opposite surfaces of the tongue, characterized by the steps of: forming the plural contacts from a single contact carrier to have one contact thereof with a contacting portion oriented reversely-symmetrically with respect to a contacting portion of another contact thereof; insert-molding the plurality of contacts with an insulator to form the insulative housing while exposing front ends of the contacts; and severing a carrier strip of the contact carrier from the front ends of the contacts while leaving the front ends inwardly of a front end surface of the insulative housing.

15 Claims, 12 Drawing Sheets

(51) Int. Cl.
*H01R 13/627* (2006.01)
*H01R 43/16* (2006.01)
*H01R 43/24* (2006.01)

(58) Field of Classification Search
USPC ..... 439/490, 79, 55, 59
See application file for complete search history.

(56) References Cited

U.S. PATENT DOCUMENTS

| | | | | |
|---|---|---|---|---|
| 7,621,788 | B1 | 11/2009 | Feng | |
| 9,748,712 | B2 * | 8/2017 | Guo | H01R 24/60 |
| 10,109,948 | B2 * | 10/2018 | Zhao | H01R 13/5219 |
| 10,211,575 | B2 * | 2/2019 | Zhao | H01R 13/6595 |
| 2017/0373439 | A1 | 12/2017 | Wen et al. | |

FOREIGN PATENT DOCUMENTS

| | | | |
|---|---|---|---|
| CN | 105449398 | A | 3/2016 |
| CN | 105024197 | B | 4/2018 |
| CN | 207572614 | U | 7/2018 |

* cited by examiner

ELECTRICAL CONNECTOR UPPER AND LOWER CONTACTS MADE FROM A SINGLE CONTACT CARRIER AND INSULATIVE HOUSING MOLDED BY ONE SHOT

BACKGROUND OF THE INVENTION

1. Field of the Invention

The present invention relates to an electrical connector including an insulative housing and a plurality of contacts molded with the insulative housing, wherein the plurality of contacts are formed from a single contact carrier and the molding operation is performed in one shot.

2. Description of Related Arts

China Patent No. 207572614 discloses an electrical connector including two rows of contacts made from respective contact carriers and an insulative housing molded to the two rows of contacts in two shots.

U.S. Pat. No. 7,621,788 discloses an electrical connector pin carrier having a main panel, a secondary panel, and a set of first pins and a set of second pins both connected between the main panel and the secondary panel. The two sets of pins have respective contacting portions to be exposed to two opposite surfaces of an insulative housing tongue.

SUMMARY OF THE INVENTION

A method of making an electrical connector which includes an insulative housing having a tongue with two opposite surfaces and a plurality of contacts with contacting portions exposed to the two opposite surfaces of the tongue is characterized by the steps of: forming the plurality of contacts from a single contact carrier to have one contact thereof with a contacting portion oriented reversely-symmetrically with respect to a contacting portion of another contact thereof; insert-molding the plurality of contacts with an insulator to form the insulative housing while exposing front ends of the contacts; and severing a carrier strip of the contact carrier from the front ends of the contacts while leaving the front ends inwardly of a front end surface of the insulative housing.

DETAILED DESCRIPTION OF THE PREFERRED EMBODIMENT

Figure 1:
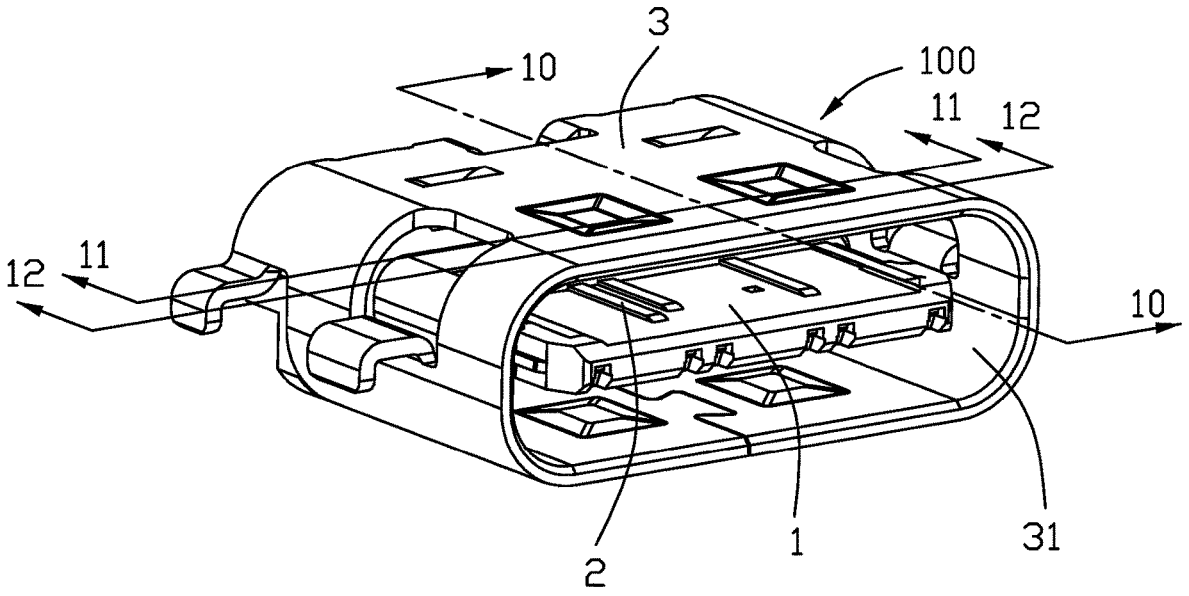
FIG. 1 is a top perspective view of an electrical connector in accordance with the present invention.
Figure 2:
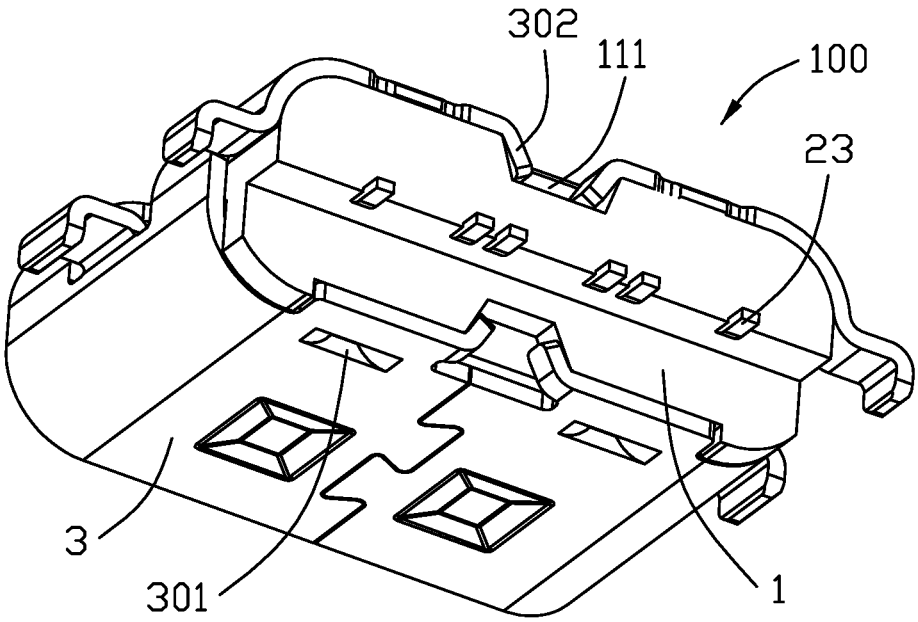
FIG. 2 is a bottom perspective view of the electrical connector.
Figure 3:
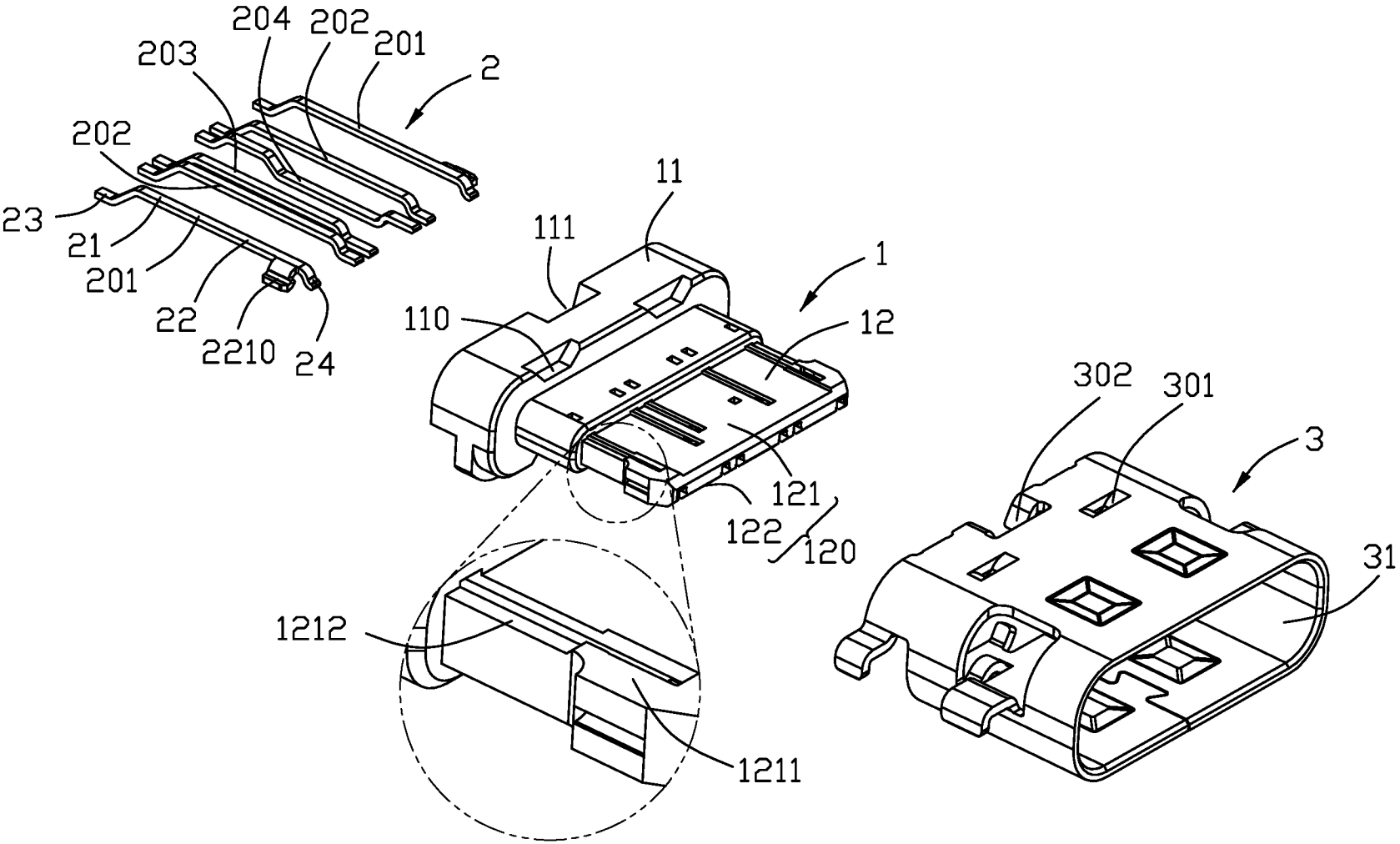
FIG. 3 is an exploded view of the electrical connector in FIG. 1.
Figure 4:
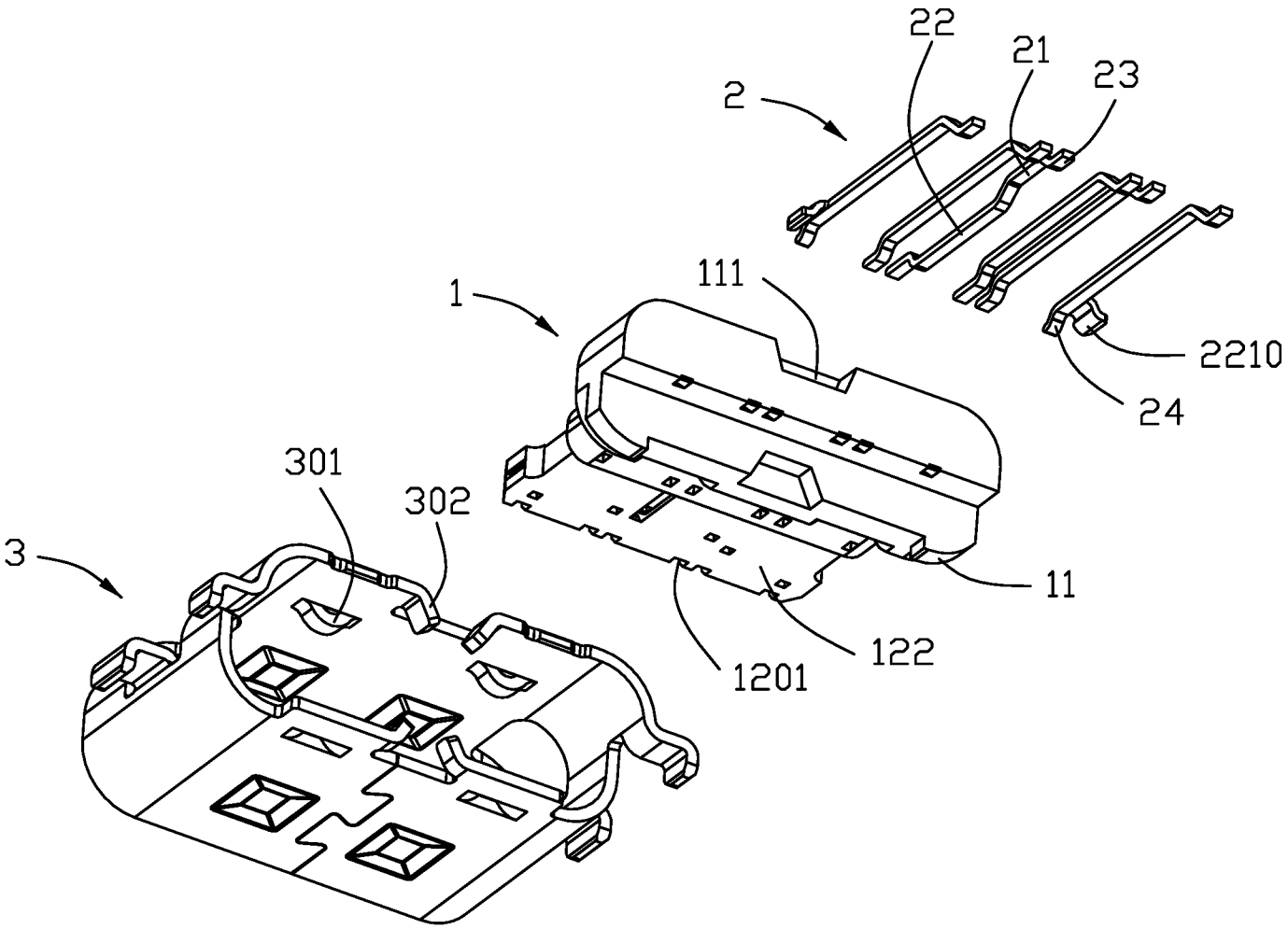
FIG. 4 is an exploded view of the electrical connector in FIG. 2.
Figure 5:
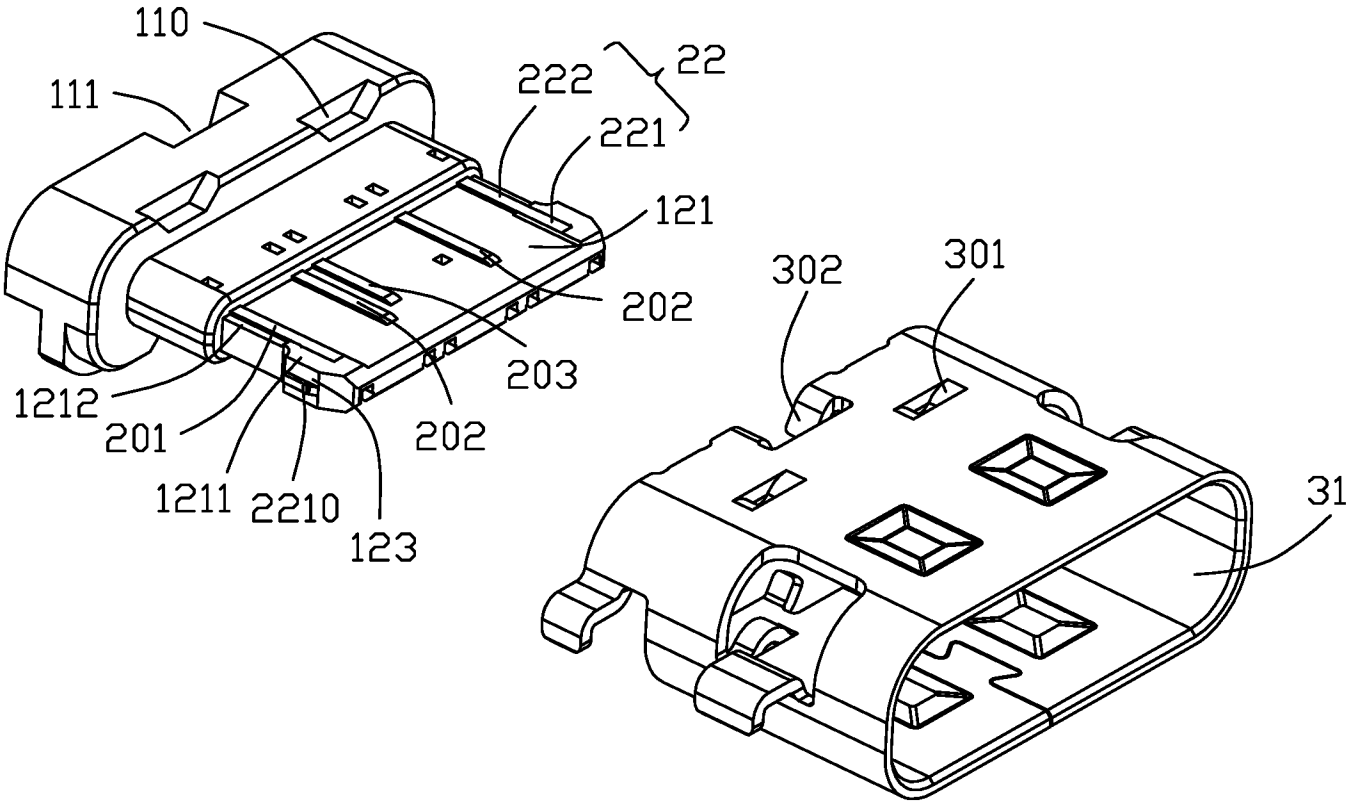
FIG. 5 is a partly exploded view of the electrical connector in FIG. 1.
Figure 6:
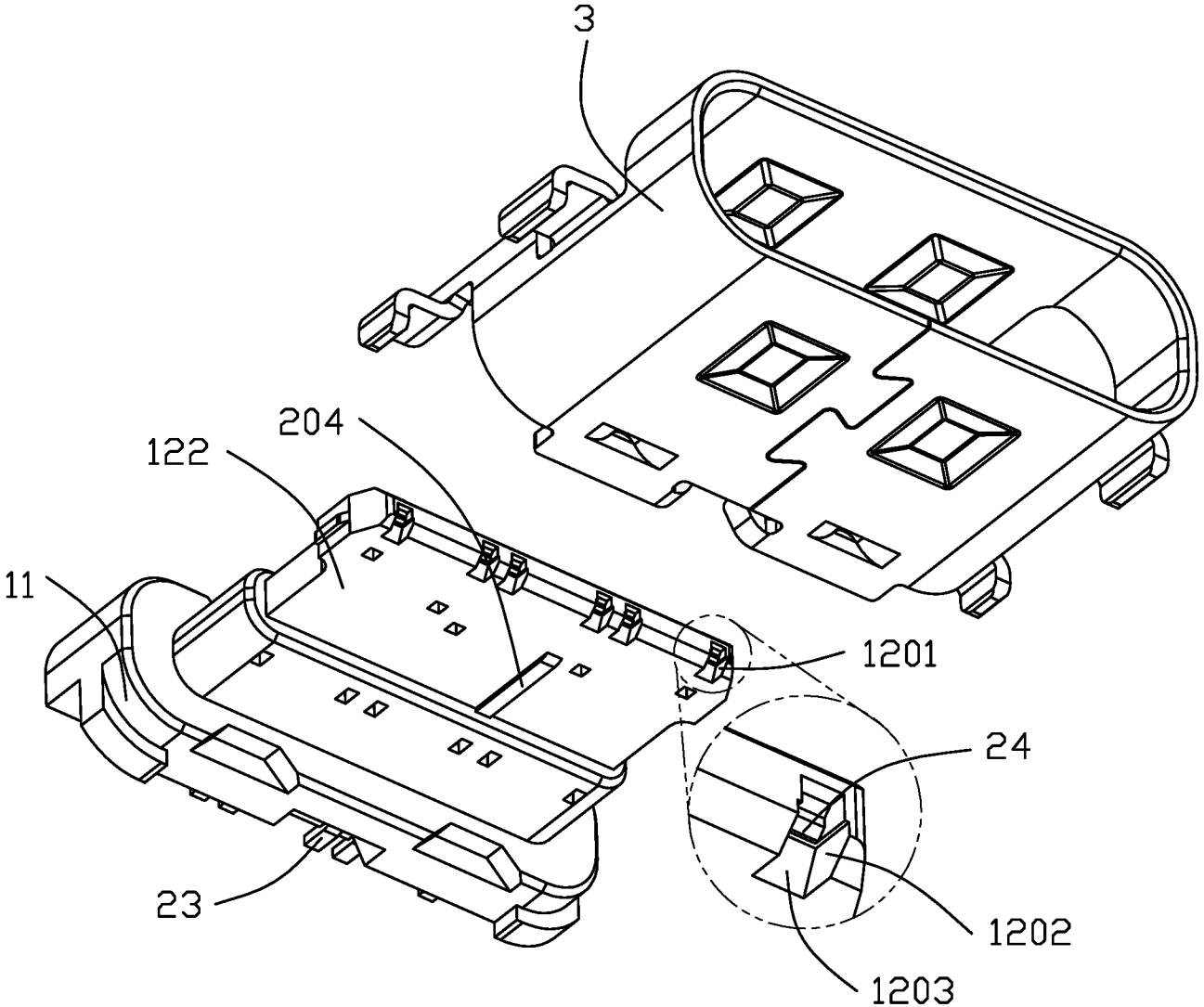
FIG. 6 is a partly exploded view of the electrical connector in FIG. 2.
Figure 7:
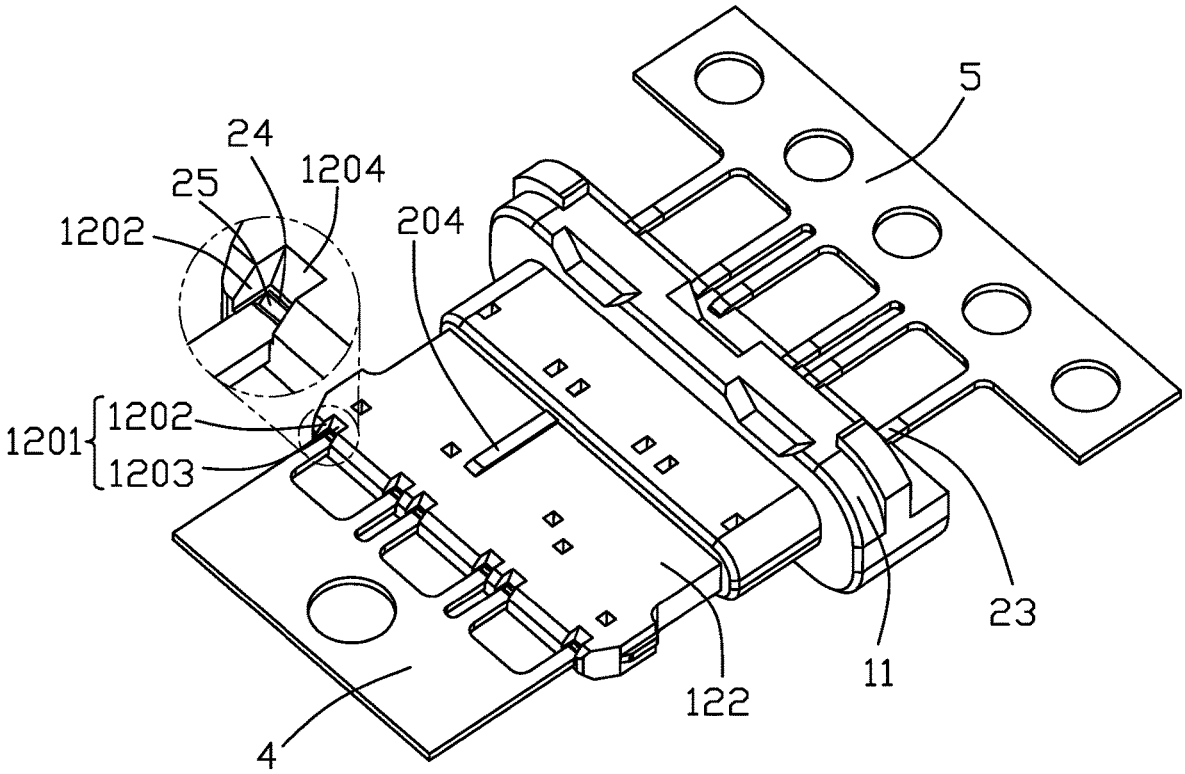
FIG. 7 shows a plurality of contacts of the electrical connector formed on a single contact carrier and an insulative housing molded with the contacts.
Figure 8:
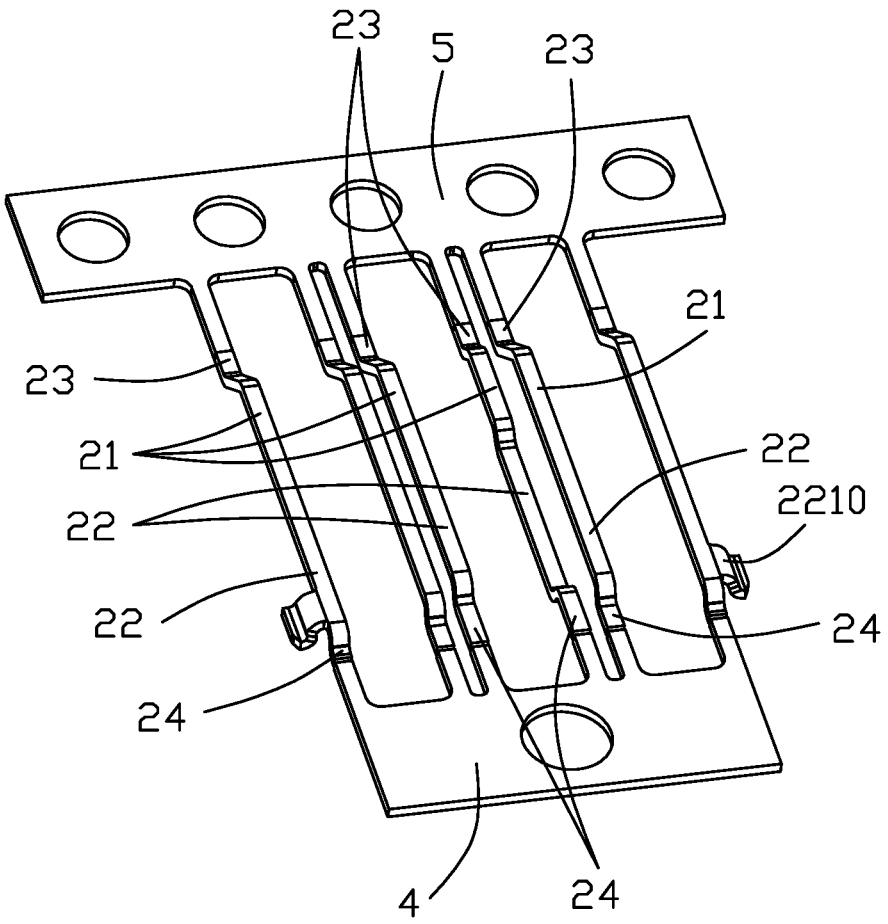
FIG. 8 shows the plurality of contacts prior to molding with the insulative housing.
Figure 9:
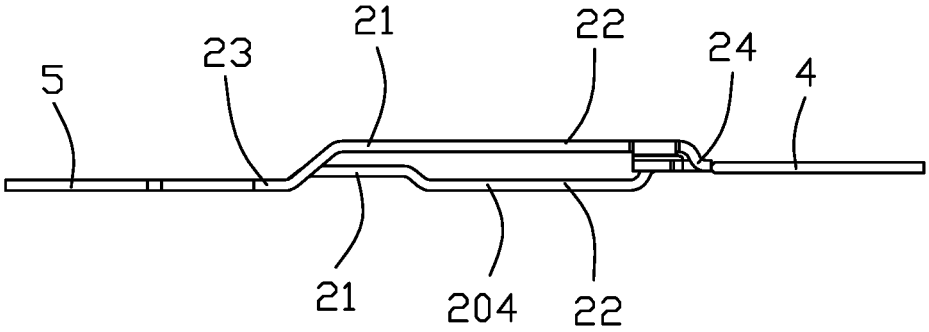
FIG. 9 is a side view of the plurality of contacts on the contact carrier.

Referring to FIGS. 1-12, an electrical connector 100 in accordance with the present invention is embodied as a USB Type C receptacle connector for charging purpose and comprises an insulative housing 1 and a plurality of contacts 2 secured to the insulative housing 1 to be commonly formed as a contact module. The electrical connector 100 may further comprise a shielding shell 3 enclosing the insulative housing 1 to form a mating space 31. The plurality of contacts 2 are molded with the insulative housing 1 in one-shot molding operation.

The insulative housing 1 has a base 11 and a frontal tongue 12. The base 11 has a pair of front positioning grooves 110 and the shielding shell 3 has a pair of positioning pieces 301. The base 11 further has a rear positioning groove 111 and the shielding shell 3 further has a pair of rear positioning pieces 302.

Each contact 2 has a securing portion 21, a front connecting portion 22 exposing to a corresponding mating surface 120 of the tongue 12, and a rear soldering portion 23. The contacting portions 22 of all contacts 2 are exposed upon two opposite surfaces of the front tongue 12 while the soldering portions 23 of all the contacts 2 are arranged at a same plane and in one row. Respective front ends of the contacts 2 are bent to form coplanar heads 24 to be embedded in the tongue 12 while exposing to grooves 1201 thereof. The groove 1201 has a pair of upper side walls 1202 and an upper rear wall 1203. During manufacturing, molding tools may be employed to press on the heads 24 within the grooves 1201. The wall 1203 may have a sloped surface 1204 for guiding corresponding contacts of a complementary connector to pass smoothly.

Figure 10:
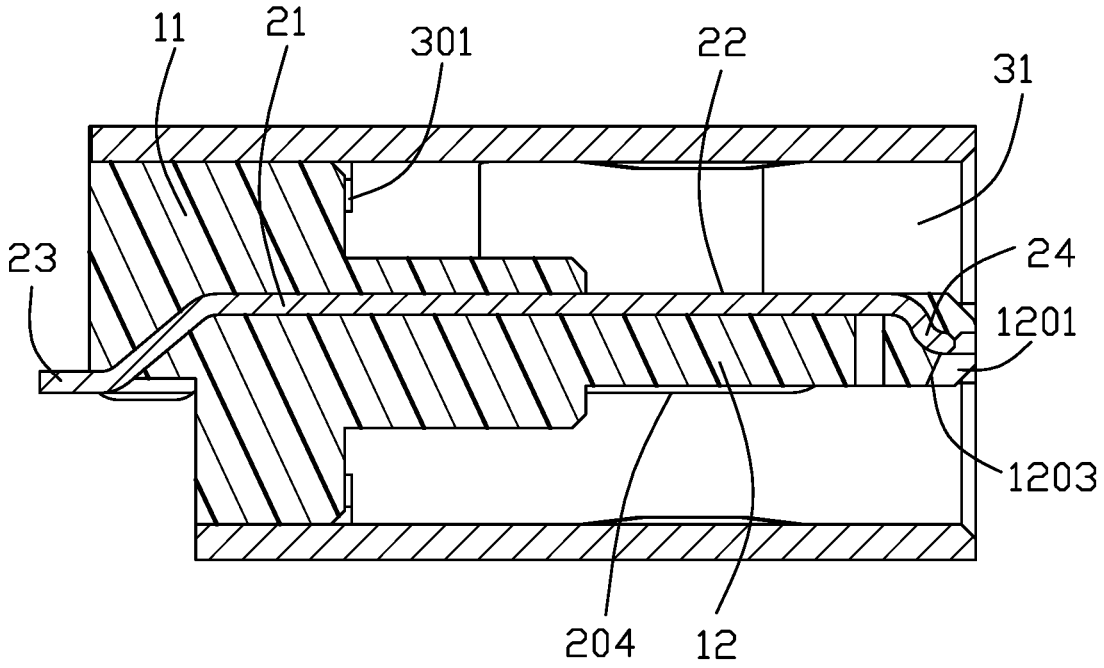
FIG. 10 is a cross-sectional view of the electrical connector taken along line 10-10 in FIG. 1.
Figure 11:
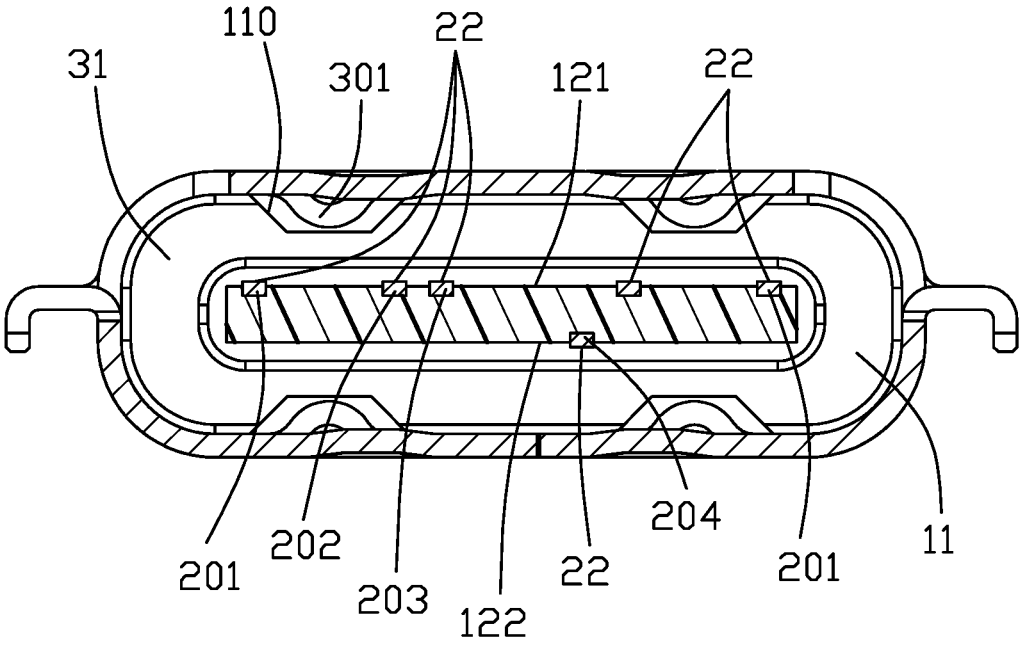
FIG. 11 is a cross-sectional view of the electrical connector taken along line 11-11 in FIG. 1.
Figure 12:
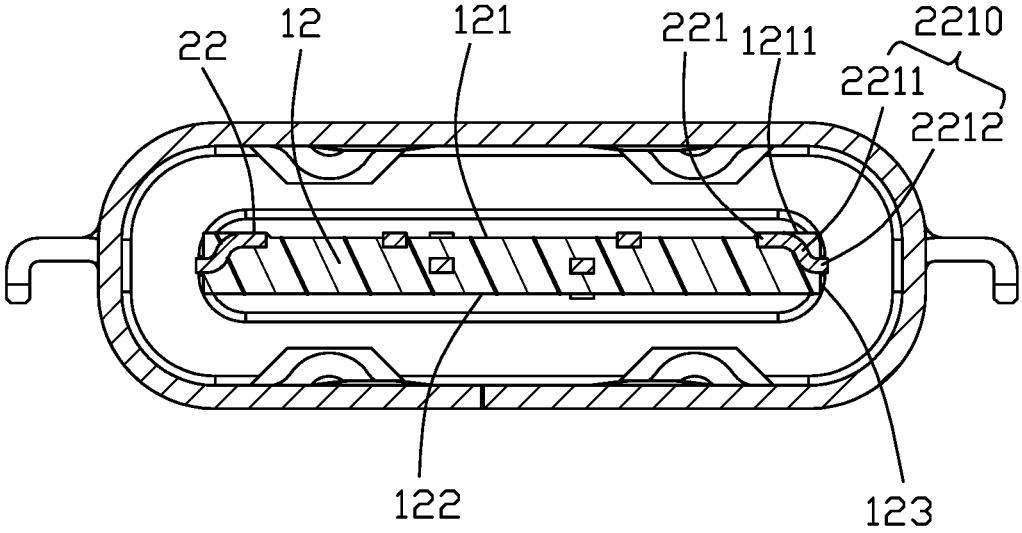
FIG. 12 is a cross-sectional view of the electrical connector taken along line 12-12 in FIG. 1.

The plurality of contacts 2 include two outermost ground contacts 201, two power contacts 202 immediately adjacent to the two ground contacts 201, and a first and second detect contacts 203 and 204. The tongue 12 has opposite first and second surfaces 121 and 122. The contacting portions 22 of the two outermost ground contacts 201, the two power contacts 202, and the first detect contact 203 are exposed to the first surface 121, forming an upper row. The contacting portion 22 of the second detect contact 204 is exposed to the second surface 122, forming a lower row. As shown in FIG. 10, there is a bend at a junction between the contacting portion 22 and the securing portion 21 of the second detect contact 204 exposed to the second surface 122, while the contacting portions 22 of the two outermost ground contacts 201, the two power contacts 202, and the first detect contact 203 exposed to the first surface 121 are coplanar with the securing portions 21 thereof.

The soldering portions 23 of the two outermost ground contacts 201, the two power contacts 202, and the first and second detect contacts 203 and 204 are coplanar. During manufacturing, the front ends of the two outermost ground contacts 201, the two power contacts 202, and the first and second detect contacts 203 and 204 are connected to a first carrier strip 4, and rear ends thereof are connected to a second carrier strip 5. A V-shaped cut 25 is formed at a junction of the first carrier strip 4 and the heads 24 for ease of severing after the insulative housing 1 is molded.

Each of the first and second surfaces 121 and 122 of the tongue 12 provides twelve (12) contact positions arranged centrally-symmetrically to support dual-orientation mating as is well known in this art, though not all contact positions are occupied. In the embodiment shown, on the first surface 121, the two ground contacts 201 occupy the first and twelfth contact positions, the two power contacts 202 occupy the fourth and ninth contact positions, and the first detect contact 203 occupies the fifth contact position; on the second surface 122, the second detect contact 204 occupies the fifth contact position.

Each of the two outermost ground contact 201 has a first part 221 and a second part 222. The first part 221 has an integral latching portion 2210. The latching portion 2210 has an upper part 2211 and a lower part 2212 exposed to a corresponding side surface 123 of the tongue 12. Each side of the tongue 12 generally has a first region 1211, i.e., the sideward locking protrusion, and a second region 1212 behind the first region 1211. Since the latching portion 2210 is generally curved and embedded within a sideward latching protrusion (not labeled) of the first region 1211 of the front tongue 12, during the insert-molding step, a respective outer part of the first surface 121 of the tongue 12 that is immediately outwardly of each ground contact 201, i.e., the first region 1211, may be molded to a level that is coplanar with a top surface of the ground contact and effectively covers the latching portion 2011 for molding consideration, while the second region 1212 is downwardly offset from and lower than the first region to avoid the potential contamination on the contacting portion of the ground contact due to the melted material of the housing spilt over the contacting portion of the ground contact during the molding process.

To make the electrical connector 100, the method may include primarily a step of forming the plurality of contacts 2 from a single contact carrier to have at least the first and second detect contacts 203 and 204 with the contacting portions 22 thereof oriented reversely-symmetrically with respect to each other and optionally to have the two outermost ground contacts 201 with the latching portions 2210; a step of insert-molding the plurality of contacts 2 with the insulative housing 1 while exposing the heads or front ends 24 thereof and optionally the latching portions 2210 if present; and a step of severing the carrier strip 4 from the front ends 24 of the plurality of contacts 2 while leaving the front ends 24 inwardly of a front end surface of the insulative housing 1. As is well known in this art, the shielding shell 3 may subsequently be assembled and the second carrier strip 5 severed.

What is claimed is:

1. A method of making an electrical connector which includes an insulative housing having a tongue with two opposite surfaces and a plurality of contacts with contacting portions exposed to the two opposite surfaces of the tongue, characterized by the steps of:

forming the plurality of contacts from a single contact carrier to have one contact thereof with a contacting portion oriented reversely-symmetrically with respect to a contacting portion of another contact thereof;

insert-molding the plurality of contacts with an insulator to form the insulative housing while exposing front ends of the contacts; and severing a carrier strip of the contact carrier from the front ends of the contacts while leaving the front ends inwardly of a front end surface of the insulative housing;

wherein the front tongue comprises respective sloped grooves forwardly exposing the front ends of the plurality of contacts;

wherein said sloped grooves communicate with an exterior in both front-to-back direction and vertical direction for removal of a contact carrier strip originally linked to the front ends of the contacts.

2. The method as claimed in claim 1, wherein the insert-molding step comprises molding a part of the top surface of the tongue to be leveled with a top surface of the outermost contact.

3. The method as claimed in claim 1, wherein the forming step comprises forming the plurality of contacts to have two outermost contacts each with a respective integral latching portion, and the insert-molding step comprises exposing the latching portions.

4. The method as claimed in claim 1, further comprising a step of enclosing a shielding shell over the insulative housing immediately after the step of severing.

5. An electrical connector comprising:

an insulative housing having a front tongue with two opposite surfaces; and a plurality of contacts being molded with the insulative housing and having respective contacting portions exposed to the two opposite surfaces of the front tongue; wherein the plurality of contacts are formed from a single contact carrier to have one contact thereof with a contacting portion oriented reversely-symmetrically with respect to a contacting portion of another contact thereof; and respective front ends of the plurality of contacts are exposed and located inwardly of a front end surface of the front tongue;

wherein the front tongue comprises respective sloped grooves forwardly exposing the front ends of the plurality of contacts;

wherein said sloped grooves communicate with an exterior in both front-to-back direction and vertical direction for removal of a contact carrier strip originally linked to the front ends of the contacts.

6. The electrical connector as claimed in claim 5, wherein a part of the top surface of the tongue is leveled with a top surface of the outermost contact.

7. The electrical connector as claimed in claim 5, wherein the plurality of contacts comprise two outermost contacts each having a respective integral latching portion.

8. The electrical connector as claimed in claim 5, wherein there are at least four contacts totally while only said one contact and said another contact are reversely symmetrically arranged with each other to have the corresponding contacting portions exposed upon the opposite surfaces, respectively.

9. The electrical connector as claimed in claim 8, where the respective front ends of all said at least four contacts are located at a same level, and the front tongue forms corresponding at least four grooves to forwardly exposed the respective front ends of all said at least four contacts so as to remove the contact carrier away from the respective front ends of all said at least four contacts via said at least four grooves.

10. The electrical connector as claimed in claim 9, wherein all said at least four grooves are exposed to an exterior in a same vertical direction.

11. The electrical connector as claimed in claim 10, wherein in all said at least four contacts, only said another contact is exposed one surface of front tongue and the remaining contacts are exposed on the other surface, and all said at least four groove are exposed upon said one surface in the same vertical direction.

12. An electrical connector comprising:

a contact module including a plurality of contacts integrally formed within an insulative housing, said housing including a rear base and a front tongue forwardly extending from the base along a front-to-back direction and defining opposite first and second surfaces thereon in a vertical direction perpendicular to the front-to-back direction, each contacts including a front contacting portion and a rear soldering portion, front ends of all the contacts being located at a same first level and said soldering portions of all the contacts being located at a same second level; wherein the first surface of the front tongue defines twelve positions along a transverse direction, which is perpendicular to both the front-to-back direction and the vertical direction, to locate the contacting portions of said contacts; wherein a total amount of the contacts is less than twelve; wherein the contacting portions of the contacts located at opposite first and twelfth positions are equipped with corresponding outwardly and laterally extending integral locking portions; wherein the integral locking portion is embedded, in the vertical direction, within and at a mid-level of a sideward locking protrusion formed on a corresponding lateral side of the tongue, and laterally exposed to an exterior in the transverse direction; wherein an upper surface of the sideward locking protrusion is roughly coplanar with an exposed exterior surface of the contacting portion of the corresponding contact located at the first position or the twelfth position; wherein a region behind the sideward locking protrusion of the lateral side of the tongue is lower than sideward locking protrusion in the vertical direction for preventing contamination upon the contacting portion of the contact located at the first position or the twelfth position.

13. The electrical connector as claimed in claim 12, wherein the second level is lower than the first level.

14. The electrical connector as claimed in claim 12, wherein the front ends of all the contacts are forwardly exposed to an exterior in the front-to-back direction when the connector is finalized.

15. The electrical connector as claimed in claim 14, wherein the front ends of all the contacts are respectively exposed in corresponding grooves which are exposed to the exterior not only forwardly in the front-to-back direction but also in the same vertical direction, either upwardly or downwardly, for a common rotational removal of a contact carrier strip away from the front ends of the corresponding contacts.

* * * * *